US007243404B2

(12) United States Patent
Weiss

(10) Patent No.: US 7,243,404 B2
(45) Date of Patent: Jul. 17, 2007

(54) WEB-SPREADING PROCESS AND WEB-SPREADING DEVICE

(75) Inventor: Reto Weiss, Thun (CH)

(73) Assignee: WIFAG Maschinenfabrik (CH)

( * ) Notice: Subject to any disclaimer, the term of this patent is extended or adjusted under 35 U.S.C. 154(b) by 512 days.

(21) Appl. No.: 10/916,734

(22) Filed: Aug. 12, 2004

(65) Prior Publication Data

US 2005/0034616 A1 Feb. 17, 2005

(30) Foreign Application Priority Data

Aug. 13, 2003 (DE) ..... 103 37 248

(51) Int. Cl.
*D06C 3/00* (2006.01)

(52) U.S. Cl. ..... 26/71; 26/51

(58) Field of Classification Search ..... 26/71, 26/99, 101, 102, 103, 7, 72, 73, 82, 87, 97, 26/51, 51.3, 51.4; 28/170; 83/425, 29, 39, 83/44, 435, 436.4, 436.6, 443, 448; 226/15, 226/17, 21, 24, 34; 271/184, 314, 302, 303, 271/305; 242/615, 615.1, 615.2, 615.21; 101/219, 220, 224, 228, 485, 226, 227
See application file for complete search history.

(56) References Cited

U.S. PATENT DOCUMENTS 844,316 A * 2/1907 Birch ..... 26/102
992,703 A * 5/1911 Birch ..... 26/102
1,748,275 A * 2/1930 Birch ..... 26/75
1,927,849 A * 9/1933 Roberts ..... 26/77
2,198,656 A * 4/1940 Cohn et al. ..... 226/23
2,214,593 A * 9/1940 Mustin et al. ..... 83/29
2,496,312 A * 2/1950 Robertson ..... 26/51.5
3,161,563 A * 12/1964 Walker et al. ..... 162/197
3,171,579 A * 3/1965 Robertson ..... 26/75

(Continued)

FOREIGN PATENT DOCUMENTS

DE 87 17 253.4 8/1988

(Continued)

*Primary Examiner*—A. Vanatta
(74) *Attorney, Agent, or Firm*—McGlew and Tuttle P.C.

(57) ABSTRACT

A web-spreading device and a web-spreading process are provided. The web-spreading device, is provided whereby a first web strand being conveyed and a second web strand being conveyed next to the first web strand in a web-processing machine can be offset in parallel to one another in order to set a spread. A frame supports a first deflecting device (5*r*; 5*r*'), which forms a first deflection axis for the first web strand (Br), and a second deflecting device (6*r*; 6*r*'), which forms a second deflection axis for the first web strand (Br), which deflection axis is the next deflection axis for the first deflection axis in the conveying direction (F). The first web strand (Br) is offset in parallel by wrapping around the deflecting device (5*r*, 6*r*; 5*r*', 6*r*') and the spread (X; X+Y) is thus set in its entirety or in part. At least one of the deflecting devices (5*r*, 6*r*; 5*r*', 6*r*') is mounted adjustably along an adjustment path in the frame (2) in order to set the spread (X; X+Y). The adjustment path is straight in its entirety or at least in one section and extends in the conveying direction (F) which the first web strand (Br) has between the deflecting device (5*r*, 6*r*; 5*r*', 6*r*').

23 Claims, 6 Drawing Sheets

U.S. PATENT DOCUMENTS

| | | | | |
|---|---|---|---|---|
| 3,719,975 | A * | 3/1973 | Illarionov et al. | 26/51.3 |
| 4,017,227 | A * | 4/1977 | Schmidt | 425/66 |
| 4,063,505 | A * | 12/1977 | Sasamoto et al. | 101/228 |
| 6,748,857 | B2 * | 6/2004 | Seiler et al. | 101/226 |
| 6,802,110 | B2 * | 10/2004 | Berweger et al. | 26/71 |
| 6,955,122 | B2 * | 10/2005 | Seiler et al. | 101/226 |
| 2002/0029785 | A1 | 3/2002 | Schafforz | |
| 2003/0200636 | A1 * | 10/2003 | Morman et al. | 28/170 |

FOREIGN PATENT DOCUMENTS

| | | |
|---|---|---|
| DE | G 87 17 253.4 | 8/1988 |
| DE | 100 23 169 | 11/2001 |
| DE | 100 44 577 | 3/2002 |
| EP | 1 386 869 | 2/2004 |
| FR | 2 570 686 | 3/1986 |

* cited by examiner

WEB-SPREADING PROCESS AND WEB-SPREADING DEVICE

FIELD OF THE INVENTION

The present invention pertains to a process and a device for spreading a web in a web-processing machine. The web-processing machine may be especially a printing press, for example, an offset printing press. Preferred examples are web-fed rotary printing presses as they are used in job printing or even more preferably for printing large editions of newspapers.

BACKGROUND OF THE INVENTION

DE 100 23 169 A1 describes a web-spreading device with two arrow-shaped turning bars, which are arranged one after another in the web conveying direction after a lengthwise cutting means and are mounted pivotably in relation to one another in a machine frame. Two web strands of a web cut lengthwise are conveyed next to one another through the web-spreading device and wrap around one half each of the arrow-shaped turning bars one after another, so that the web strands are offset in parallel and have a spread between them when they run off from the web-spreading device. By pivoting only one of the arrow-shaped turning bars or both turning bars in relation to one another, the lengths of the web strands between the arrow-shaped turning bars and the wrapping angles with which the web strands wrap around the arrow-shaped turning bars are changed and the spread is adjusted as a result. However, changes in the web tension are associated with the adjustment of the spread.

SUMMARY OF THE INVENTION

One object of the present invention is to reduce and preferably avoid variations in the web tension during the setting of the spread between web strands being conveyed in parallel next to one another into a spreading device.

In a web-spreading process like the one to which the present invention pertains, a first web strand and a second web strand are conveyed next to one another in a web-processing machine and they are offset in parallel to one another by the spread. The spread is the clear distance measured between the edges of the web strands, which edges face one another, after the parallel offset. To obtain the spread, both web strands may be offset in parallel in relation to themselves and in relation to one another, or it is also possible to offset in parallel only one of the web strands in relation to one another and in relation to the other web strand. The first web strand wraps one after another around a first deflecting means, which forms a first deflection axis for the first web strand, and, downstream of the web, a next, second deflecting means, which forms a second deflection axis for the first web strand, over a wrapping angle each, preferably over the same wrapping angle. The deflecting means are arranged such, namely, each obliquely to the conveying direction of the first web strand running in, that the first web strand running off from the second deflecting means is offset in parallel in relation to the first web strand running onto the first deflecting means. To adjust the spread, at least one of the deflecting means is adjusted from a first position into another, second position, in which the first web strand travels over a path length between the first deflecting means and the second deflecting means that is different from the corresponding path length in the first position.

According to the present invention, the second position of the adjusted deflecting means is selected to be such that the conveying direction of the first web strand between the deflecting means is not changed by the adjustment. This means that the wrapping angle is not changed, at least it is not changed by the adjustment of the at least one of the deflecting means. Therefore, the first web strand runs off from the same angle location on the outer circumference of the first deflecting means and runs off at the same angle location on the outer circumference of the second deflecting means after the adjustment of the spread as it did before the adjustment. Since changes in the web tension due to the spreading depend primarily on changes in the wrapping angle, changes in the web tension are avoided by the spreading process according to the present invention. An intake guide means is especially preferably arranged upstream of the first deflecting means along the web, and a next outlet guide means downstream of the second deflecting means along the web is arranged such that the ratios do not change due to the adjustment when the first web strand runs onto the first deflecting means and when it runs off from the second deflecting means, so that not only does the wrapping angle remain unaffected by the adjustment, but it remains absolutely the same.

The present invention pertains not only to a web-spreading process, but also to a web-spreading device, by means of which the web strands being conveyed next to each other in a processing means can be offset in parallel to one another in order to set the spread. The present invention pertains not only to the web-spreading device installed in the web-processing machine, but also to the web-spreading device only intended for installation. The web-spreading device comprises a frame, the first deflecting means and the second deflecting means. The deflecting means are, as was explained above, designed and arranged such that the first web strand is offset in parallel by wrapping around the deflecting means and the spread is thus set in its entirety or in part. At least one of the deflecting means, preferably the second deflecting means, is mounted adjustably along an adjustment path in the frame in order to make it possible to set the spread.

The device according to the present invention is characterized in that the adjustment path is straight and extends in the conveying direction of the first web strand between the first deflecting means and the second deflecting means. A line that is parallel to the web plane formed by the first web strand between the deflecting means and is located at a spaced location from the first web strand is also defined as being a line pointing in the conveying direction. It is ensured by such a selection of the adjustment path that the first web strand maintains its conveying direction between the deflecting means during the entire adjustment of the deflecting means. The adjusting movement as such, which is performed by the at least one adjustable deflecting means from the first position into the second position, does not consequently change the wrapping angle with which the first web strand wraps around the first deflecting means and the second deflecting means. The particular wrapping angle can be changed, if necessary, by adjusting an intake guide means arranged in front or an outlet guide means arranged downstream. However, the wrapping angle is always the same in the first and second positions of the at least one adjustable deflecting means and even more preferably also in the other positions which the deflecting means for the first web strand can advantageously assume in relation to one another. Because the adjustment path is straight, the wrapping angle is invariant against any adjusting movement performed along the adjustment path between the first position and the second position.

If the at least one adjustable deflecting means can be adjusted up to a position in which it does not bring about an offset of the first web strand and is preferably not in contact with the first web strand, the adjustment path preferably extends as a straight line into this position, but this does not inevitably have to be so. Adjustability up to a position of the at least one deflecting means, in which the web does not wrap around this deflecting means and preferably around the other of the deflecting means, either, and even more preferably has no contact with the deflecting means at all, is advantageous for drawing in a new web. If the at least one adjustable deflecting means can assume such a position, this position is, of course, neither the "first position" nor the "second position" in the sense of the present invention.

In preferred embodiments, the at least one of the deflecting means that is adjusted for setting or adjusting the spread is adjustable not only into a first position and into a second position, but also into more than two different positions, in which the first web strand travels between the deflecting means over a path length that is different from the path length in the first position, but maintains its conveying direction and, even more preferably, the wrapping angle.

Deflecting means are also provided in preferred embodiments for the second web strand, just as for the first web strand, and at least one of these deflecting means is adjustable. The second web strand can be offset in parallel by means of the deflecting means provided for the second web strand, namely, another first deflecting means and another second deflecting means. The statements made in connection with the deflecting means for the first web strand preferably apply to the additional deflecting means.

Not inevitably in each production that can be performed by means of the web-processing machine, preferably print productions, but in one or more of these productions, the deflecting means for the web strands assume such positions that both the first web strand and the second web strand are offset in parallel in order to obtain the spread only by the parallel offset. It is advantageous for the wrapping angle with which the first web strand wraps around the deflecting means associated with it and the wrapping angle with which the second web strand wraps around the additional deflecting means associated with it for a parallel offset to be equal. This is preferably true of each of the positions that the at least one adjustable deflecting means for the first web strand and the at least one additional adjustable deflecting means for the second web strand can assume between the respective first and second positions.

It is especially preferred if each of the web strands is offset in parallel in each production. However, to make it nevertheless possible for this purpose to convey one of the web strands with the smallest possible parallel offset, the deflecting means for this at least one of the web strands point obliquely in the conveying direction of the web strand in question at a contact angle that should be greater than 85° and smaller than 90° and preferably at least 87° and at most 89°. The deflecting means that are associated with the other of the web strands advantageously point obliquely in the conveying direction of the other web strand at a smaller contact angle, preferably at a contact angle that is at least 45° and at most 85°, i.e., a contact angle from the range of angles that is usual for spreading devices. The feature of the different contact angles is already advantageous as such, i.e., without the adjustment paths designed according to the present invention, for reducing variations in the web tension, but it may itself be advantageously varied by such a design of the adjustment paths.

The web strands can run out of the web-spreading device in different directions after the spreading. However, they are parallel in a view perpendicular to the plane of one of the web strands. However, they preferably form offset, but parallel planes or a single, common plane when running out of the web-spreading device.

The web strands spread apart from one another by means of the web-spreading device are conveyed during the running production into a processing mechanism of the processing machine, for example, a printing mechanism of a printing press, and processed there corresponding to the purpose of the processing machine. In case of a printing press, they are printed on in one or more colors on one side or on both sides and subsequently subjected to further processing to obtain the finished printed product.

The present invention will be explained below on the basis of exemplary embodiments. Features that become obvious from the exemplary embodiments lead to variants of the subjects of the claims individually and in any combination of features and the above-described embodiments. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
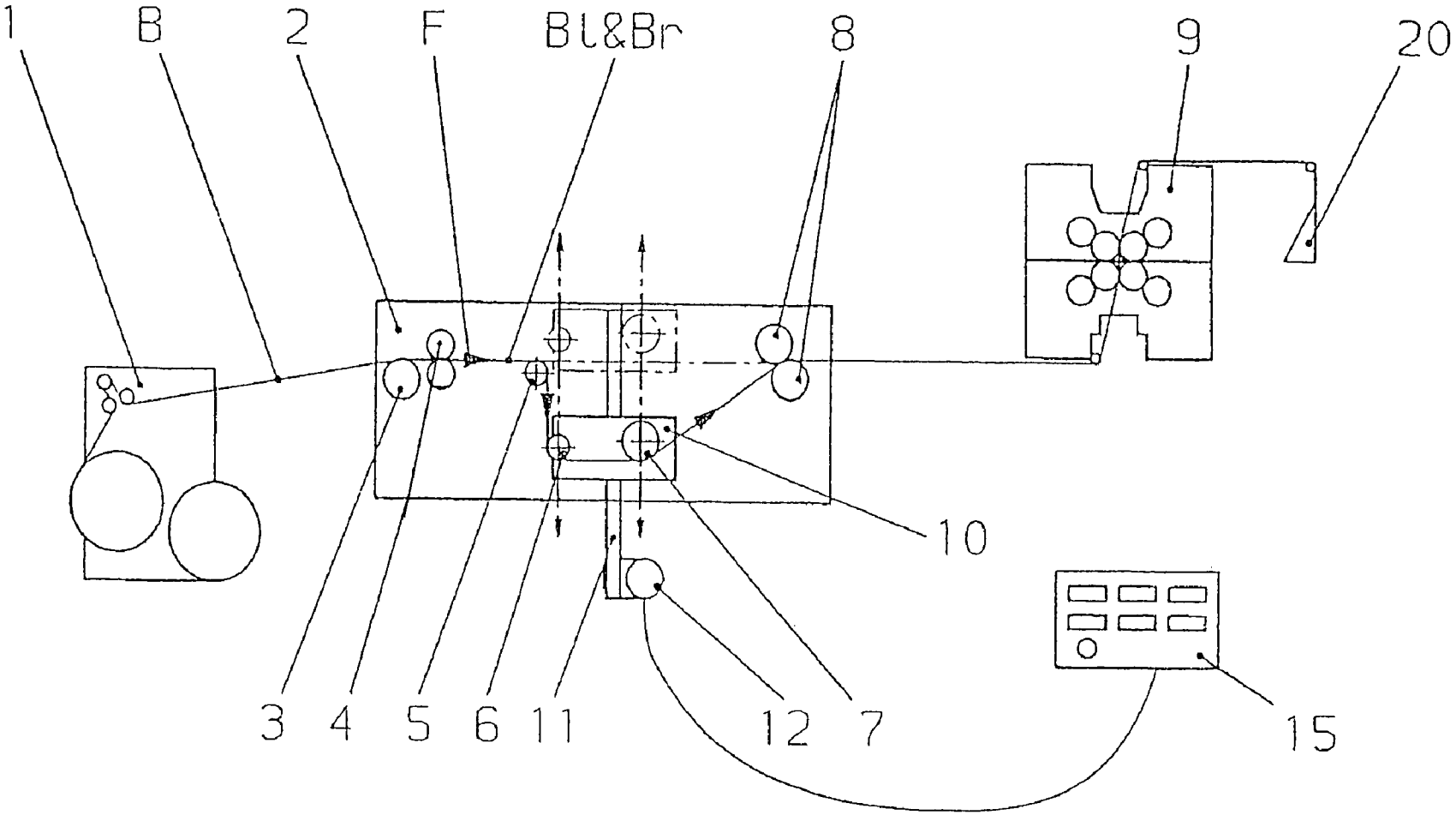
FIG. 1 is a schematic view showing a web-spreading device according to a first exemplary embodiment in a web-fed rotary printing press.

Referring to the drawings in particular, FIG. 1 shows components of a web-fed rotary printing press, which comprises a web-spreading device according to the present invention. The path of a web B to be printed on from a roll changer 1 via a web-spreading device to a printing unit 9, which is designed as a printing tower, is shown. A lengthwise cutting means 4, which is used to cut the web B lengthwise into two web strands, namely, a first web strand Br and a second web strand Bl, and deflecting means 5 and 6, which are used to spread the web strands Bl and Br formed apart from one another in parallel, belong to the spreading device. The spread-apart web strands Bl and Br are conveyed in the web conveying direction F to a printing tower 9 and printed on in multiple colors on both sides there. The parts of the printing tower 9 shown are two cylinder bridges, each formed from two rubber blanket cylinders printing on the web strands Bl and Br and from an associated plate cylinder each. The printing tower 9 may, of course, also comprise more such cylinder bridges in order to print, e.g., in four colors on both sides of the web strands Bl and Br. After the printing tower 9, the web strands Bl and Br are led either separately, each alone, or with at least one additional web strand, to formers, of which a former 20 is shown, or together to a common former 20, and separated in the formers or folded lengthwise together in the former. A folder or a plurality of folders may be arranged after the former 20 or the plurality of formers in the web conveying direction F for cross-cutting and cross-folding.

The uncut web B running into the spreading device from the roll changer 1 is conveyed via an intake guide means 3 to the lengthwise cutting means 4. The lengthwise cutting means 4 is formed essentially by two cutting rollers, which can be brought into contact with one another and can be separated from one another and between which the web is fed through. The first web strand Br is formed as the right-hand web strand and the second web strand Bl is formed as the left-hand web strand as a result of the lengthwise cutting. The parallel web strands Bl and Br, which are running at closely spaced locations next to one another, are led over a first deflecting means 5, a second deflecting means 6 immediately following same and an outlet guide means 7. They are subsequently led to the printing tower 9 via additional guide means, of which a guide means 8 following closest to the outlet guide means 7 is shown. The intake guide means 3, the lengthwise cutting means 4 and the first deflecting means 5 are mounted in fixed positions in relation to one another in a frame 2. The intake guide means 3 is a guiding roller, which is mounted rotatably in the frame 2. The first deflecting means 5 is not rotatable.

The second deflecting means 6 is mounted movably in a linearly guided manner in the frame 2 together with the outlet guide means 7. A linear guideway 11 of the mount is rigidly connected with the frame 2. The second deflecting means 6 and the outlet guide means 7 are movable continuously to and fro between two end positions along the linear guide 11. One of the two end positions is indicated by a solid line and the other by a broken line in FIG. 1. A control means 15 controls a drive means 12 on the basis of preset values that can be entered in the control means 15 or in a higher-level machine control, so that the second deflecting means 6 and the outlet guide means 7 assume the desired adjusted position over the adjustment path.

Figure 2:
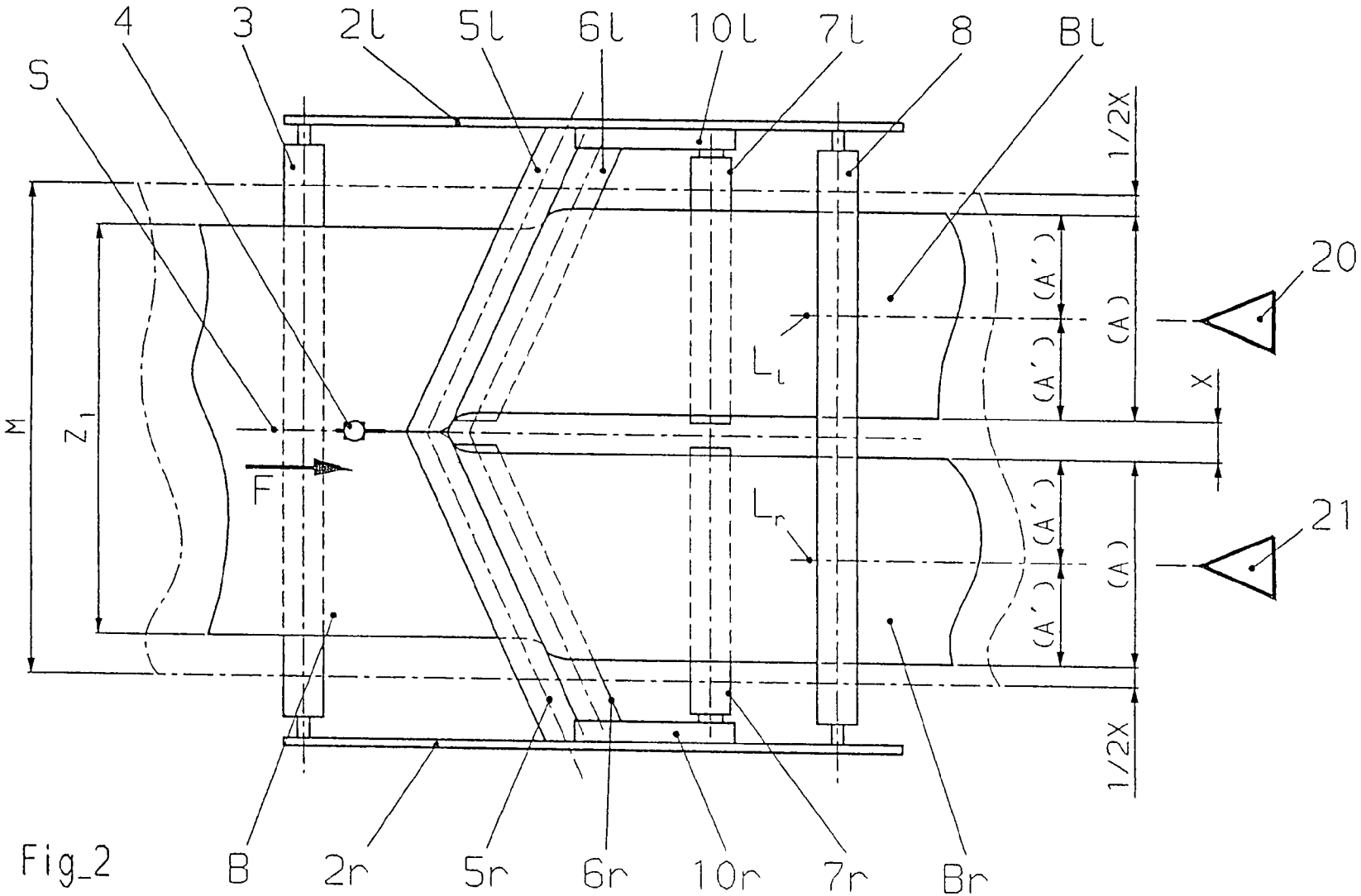
FIG. 2 is view of the web-spreading device in a state in which two strands of a web are spread apart symmetrically to one another and are led centrally to a former each.

FIG. 2 shows the web-spreading device in a first state in a top view of the plane of the web. The second deflecting means 6 and the outlet guide means 7 are divided in the middle into two symmetrical halves. The two halves, guided linearly independently from one another, are mounted movably on a linear guide 11 each, which is a rigid part of the frame (FIG. 1). The adjustment paths as well as the end positions of the two halves are the same. The movements of the two halves are controlled by the control means 15 via the drive means 12 and optionally also regulated. Thus, the two halves can be moved especially together or individually or even in opposite directions along their adjustment paths and fixed in any position between the end positions.

Due to the central splitting, a second left-hand deflecting means **6*l* and a second right-hand deflecting means 6*r* as well as a left-hand outlet guide means 7*l* and a right-hand outlet guide means 7*r* are formed. The second left-hand deflecting means 6*l* and the left-hand outlet guide means 7*l* are associated with the left-hand web strand Bl, i.e., they come into contact with the left-hand web strand Bl only. The second right-hand deflecting means 6*r* and the right-hand outlet guide means 7*r* are associated with the right-hand web strand Br, i.e., they come into contact with the right-hand web strand Br only. The first deflecting means 5 is assigned correspondingly as well. The first deflecting means 5 is, however, fastened in the frame on its two opposite sides 2*l* and 2*r*. The first deflecting means 5 is broken down functionally into a first left-hand deflecting means 5*l* and a first right-hand deflecting means 5*r*. The deflecting means 5*l*, 5*r*, 6*l* and 6*r*** have the same cross section each. They are designed as round bars in the exemplary embodiment.

In the top view of the plane of the web B running in, the first deflecting means **5*l* and 5*r* and especially the deflection axes formed by them form an arrow shape, whose head points toward the web conveying direction F. The first deflecting means 5*l* and 5*r* are rigidly connected with one another in the middle in the area of the "arrowhead." The head itself is rounded in order to avoid the risk of tearing the web B. The lengthwise cutting means 4 and the tip formed by the first deflecting means 5*l* and 5*r*** are located exactly on the machine axis S. The arrangement of the parts of the spreading device, which are associated with the left-hand web strand Bl, is symmetrical to the arrangement of the parts that are associated with the right-hand web strand Br. The machine axis S thus also forms at the same time the axis of symmetry of the spreading device.

The left-hand deflecting means **5*l* and 6*l* form deflection axes that are parallel to one another for the left-hand web strand Bl. The right-hand deflecting means 5*r* and 5*l* form deflection axes that are parallel to one another for the right-hand web strand Br. The adjustment paths of the two deflecting means 6*l* and 6*r* extend such that the parallelism of the deflection axes is preserved in each adjusted position of the second deflecting means 6*l* and 6*r***.

The outlet guide means **7*l* and 7*r* are arranged in relation to the second deflecting means 6*l* and 6*r* such that the web strand plane formed by the second left-hand deflecting means 6*l* and the left-hand outlet guide means 7*l* in case of wrapping and the web strand plane defined by the second right-hand deflecting means 6*r* and the right-hand outlet guide means 7*r* in case of wrapping are parallel to the web plane that is preset by the intake guide means 3 and the two first deflecting means 5*l* and 5*r* in case of their being wrapped around. The outlet guide means 7*l* and 7*r* form deflection axes pointing perpendicularly to the web conveying direction F. The second left-hand deflecting means 6*l* and the left-hand outlet guide means 7*l* are mounted together on a left-hand carriage 10*l*. The mounting on the carriage 10*l* is such that the deflection axes of the second left-hand deflecting means 6*l* and of the left-hand outlet guide means 7*l* in relation to the carriage 10*l* are adjustable, if necessary, within the framework of the tolerance-compensating adjustment. The same also applies analogously to the mounting of the second right-hand deflecting means 6*r* and the right-hand outlet guide means 7*r* at the right-hand carriage 10*r*. The two carriages 10*l* and 10*r* are movable on their respective frame sides 2*l* and 2*r* along a linear guide 11 of their own, the left-hand linear guide 11 extending in parallel to the right-hand linear guide 11 and being arranged at the same level in relation to the web conveying direction F. The two outlet guide means 7***l* and 7*r* can be mounted rotatably at the corresponding carriages 10*l* and 10*r*. The same also applies, in principle, to the two deflecting means 6*l* and 6*r*, but the design in the form of a nonrotatable bar is preferred for the deflecting means 6*l* and 6*r* because of the simpler construction.

In the state of the spreading device shown in FIG. 2, the second left-hand deflecting means 6*l* and the second right-hand deflecting means 6*r* assume an adjusted position each, in which they define a single plane, which is plane parallel to the web B running in, for the web strands Bl and Br together with the outlet guide means 7*r* and 7*l*. The second deflecting means 6*l* and 6*r* also form an arrow shape with one another in such positions, but with a narrow gap between their free ends, which exactly overlap each other in these positions. The deflection axes formed by the second deflecting means 6*l* and 6*r* correspondingly intersect. The deflection axes formed by the outlet guide means 7*l* and 7*r* are aligned in these adjusted positions.

The web B runs into the spreading device symmetrically to the machine axis S. Because of this symmetry of the web and the position of the second deflecting means 6*l* and 6*r* in a common plane, the two web strands Bl and Br are spread apart from one another toward one side each away from the machine axis S by the same offset and in parallel to the outside. The spread X is obtained, which designates the clear distance measured at right angles to the web conveying direction F between the web strands Bl and Br. The distance measured in the plane of the web between a left-hand limiting line and a right-hand limiting line, up to which the web strands Bl and Br can be maximally offset to the left outside and to the right outside in parallel by means of the spreading device in case of a sufficient web width, is designated by "M." A distance X/2 is left between the left-hand outer edge of the left-hand web strand Bl and the left-hand limiting line in the state of the spreading device shown with symmetrical intake of the web B. An equal distance is also left between the right-hand limiting line and the right-band web edge of the right-hand web strand Br. Because of the web width Z, the symmetrical intake, the symmetrical cutting and the symmetrical spreading to the spread X, the left-hand web strand Bl runs centrally into the longitudinal former 20 associated with it, and the right-hand web strand Br likewise runs centrally into the longitudinal former 21 associated with it. The web strands Bl and Br are also printed symmetrically with their respective longitudinal folds Ll and Lr. The widths of the web strands Bl and Br are designated by A, and the partial widths on both sides of the longitudinal folds Ll and Lr are designated by A'. Thus, Z=2A=4A'. It shall be noted that the former 20 and the former 21 may be formed by a single former.

In a second state of the spread device shown in FIG. 2, the web B runs into the spreading device asymmetrically to the machine axis S. The longitudinal axis of symmetry of the web B is designated by $S_B$. It is offset laterally in relation to the machine axis S. The web B is cut by means of the cutting means 4 asymmetrically corresponding to the offset of the axes S and $S_B$ into a left-hand web strand Bl and a right-hand web strand Br.

In the second state, the right-hand carriage 10*r* with the second right-hand deflecting means 6*r* and with the right-hand outlet guide means 7*r* does not protrude into the path of the right-hand web strand Br and correspondingly has no wrapping-around contact with the right-hand web strand Br. The right-hand web strand Br also fails to wrap around the first right-hand deflecting means 5*r*. The right-hand web strand Br is therefore led through the spreading device without a lateral offset. The adjusted position of the second right-hand deflecting means 6*r* and of the right-hand outlet guide means 7*r* corresponds to the position indicated by broken line in FIG. 1. The second left-hand deflecting means 6*l* and the left-hand outlet guide means 7*l* are, however, moved into the path of the left-hand web strand Bl, e.g., up to the other end position indicated by solid line in FIG. 1. The roll changer 1 is set in the exemplary embodiment according to FIG. 3 such that the right-hand web strand Br is conveyed as far as possible on the outside on the right. The right-hand outer edge of the web strand Br coincides with the right-hand limiting line of the web-spreading device. The arrangement of the spreading device in relation to the formers 20 and 21 is such that the web strands of a web B of the maximum width Z=M run without parallel offset, and even centrally to the formers 20 and 21. In the web guiding example according to FIG. 3, the right-hand web strand Br is conveyed with its outer edge along the right-hand edge that is the outermost edge for it centrally in relation to the associated longitudinal former 21. The left-hand web strand Bl, which is narrower by twice the offset of the axes S and $S_B$, should be conveyed eccentrically to the longitudinal former 20 associated with it if it also passed through the web-spreading device unaffected. However, the second left-hand deflecting means 6*l* has been moved together with the left-hand outlet guide means 7*l* in relation to the first left-hand deflecting means 5*l* into such an adjusted position that it undergoes a parallel offset corresponding to the spread X, which is so great that the left-hand web strand Bl is conveyed centrally to the associated longitudinal former 20.

Figure 3:
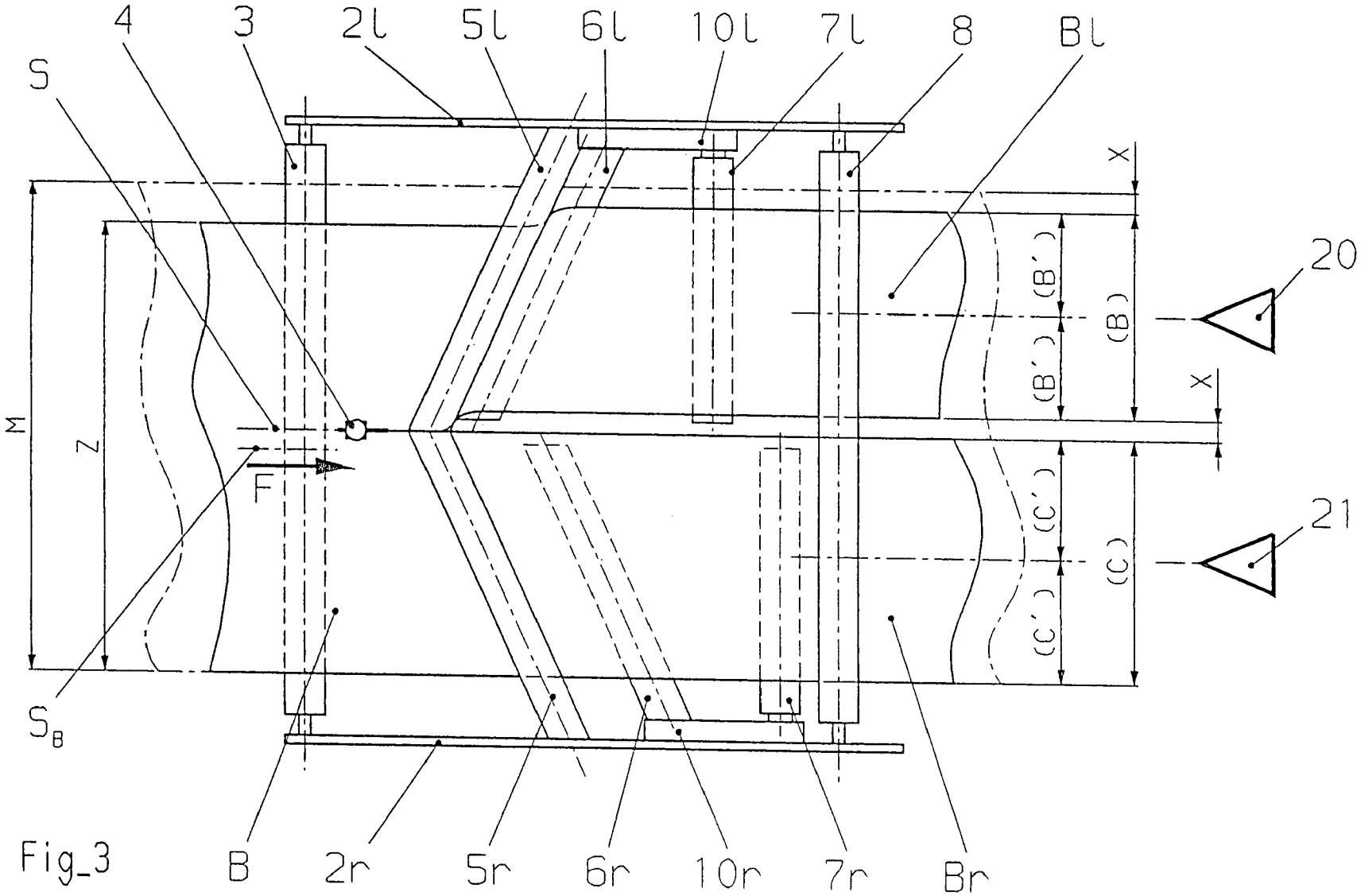
FIG. 3 is a view of the web-spreading device in a state in which the strands of a web are spread apart asymmetrically from one another and are led centrally to a former each.

It is assumed for the web guiding example according to FIG. 3 that the web B has a width Z different from the width of the web B in the first example shown in FIG. 2. The distance X between the outer edge of the left-hand web strand Bl and the left-hand limiting line corresponds to the spread X. The widths of the web strands Bl and Br are designated by B and C. On both sides of the fold lines Ll and Lr, the web strands Bl and Br have the same widths, which are designated by B' for the left-hand web strand Bl and by C' for the right-hand web strand Br, because of the central conveying to the longitudinal formers 20 and 21.

Figure 4:
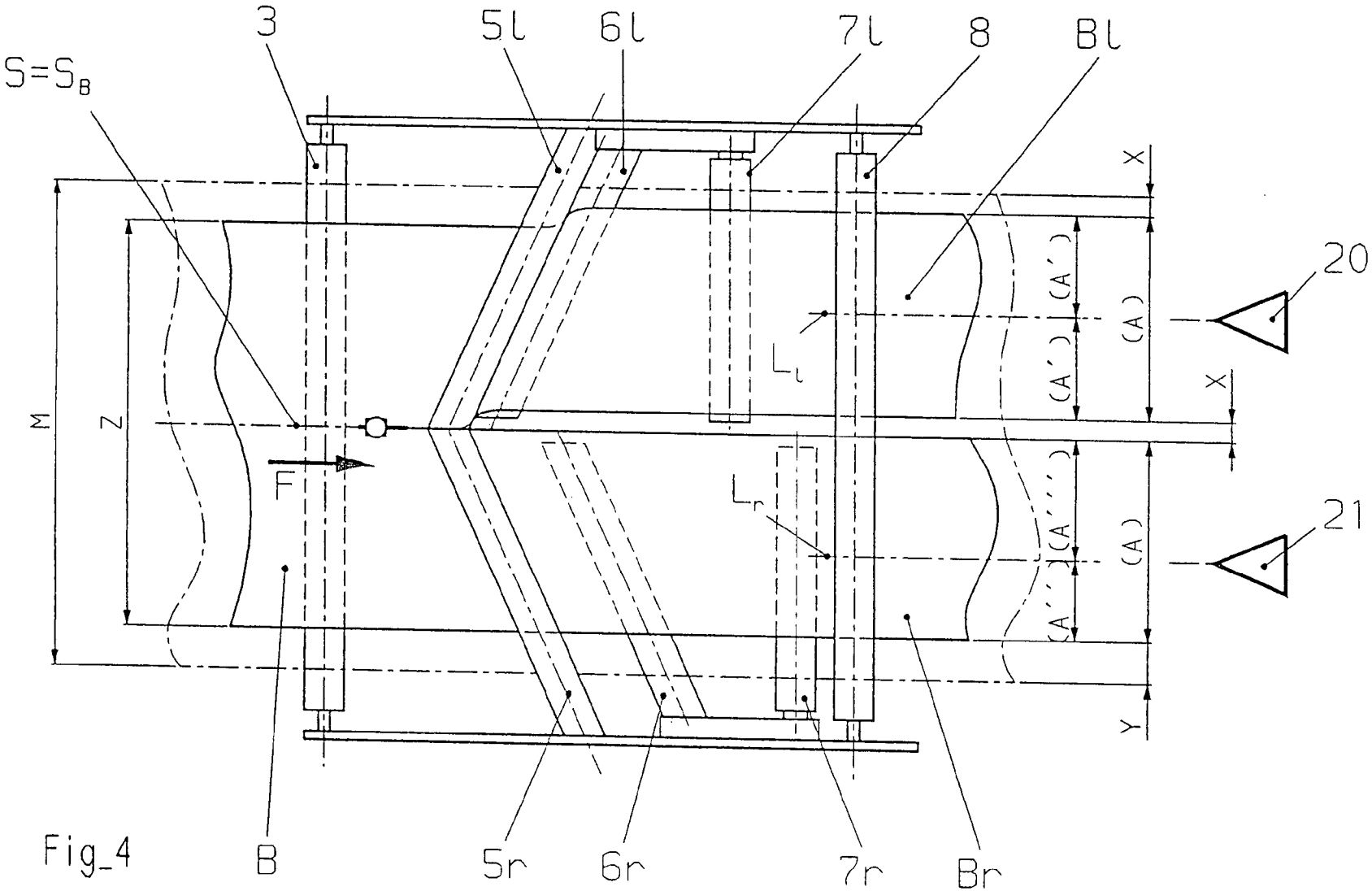
FIG. 4 is a view of the spreading device in a state in which the strands of a web are spread apart asymmetrically from one another and one of the webs is led centrally and the other of the web strands is led eccentrically to a former.

In the third web guiding example shown in FIG. 4, the web B is conveyed by the roll changer 1 symmetrically with the machine axis S, i.e., the machine axis S coincides with the central longitudinal axis $S_B$ of the web B. Since the lengthwise cutting is performed on the machine axis S, the two web strands Bl and Br formed have an equal width A, and the width Z of the web is assumed to be the same as in the web guiding example according to FIG. 2. The web-spreading device is in the second state in the web guiding example according to FIG. 4. The right-hand web strand Br correspondingly passes through the web-spreading device unaffected. Unlike in the web guiding example according to FIG. 3, the right-hand web strand Br has, however, a distance Y from the outermost right-hand edge, so that the right-hand web strand Br would be folded centrally lengthwise, as in the first web guiding example according to FIG. 2, only if it were offset by the web-spreading device in parallel to the right by the parallel offset Y/2 in relation to the machine axis S. The right-hand web strand Br is consequently conveyed in the case of the web strand guiding according to the third web guiding example eccentrically to the longitudinal former 21 and is folded lengthwise correspondingly eccentrically. The print printed on it is correspondingly asymmetric. The partial width of the right-hand web strand Br on one side of the longitudinal fold line Lr is designated by A", and the width on the other wide of the longitudinal fold line Lr, which latter width is different from the first width, is designated by A'''. The second left-hand deflecting means 6*l* assumes in relation to the first left-hand deflecting means 5*l* such an adjusted position that the left-hand web strand Bl is conveyed centrally to the longitudinal former 20. The parallel offset X of the left-hand web strand Bl corresponds to the spread. The partial widths on both sides of the longitudinal fold lines L1 are equal in the left-hand web strand Bl and are correspondingly designated by A'.

When the free beginning of a new web is drawn in, the new web is led from the roll changer 1 over the intake guide means 3 and between the cutting rollers of the cutting means 4, which said cutting rollers are moved apart from one another. The beginning of the web is subsequently led up to the additional outlet guide means 8 in a straight line, i.e., without wrapping around the deflecting means 5*l* through 6*r* and the outlet guide means 7*l* through 7*r* and is drawn in onto the formers 20 and 21, wrapping around the outlet guide means 8 and optionally over more additional guide means through the printing gap or the plurality of printing gaps of the printing tower 9. As was mentioned above, the formers 20 and 21 may be a single former, on which the two web strands Bl and Br are brought together. The second deflecting means 6*l* and 6*r* and the outlet guide means 7*l* and 7*r* assume their end position indicated by broken line in FIG. 1, which can also be called the intake position. The web, which is still uncut during the intake, is likewise indicated by broken line and is designated by B'. After the web B' has reached the former or formers, it is cut lengthwise with the cutting means 4 into the web strands Bl and Br. The deflecting means 6*l* and 6*r* or only the second deflecting means 6*l* and 6*r* and, together with same, the particular associated outlet guide means 7*l* and 7*r* of the outlet guide means 7*l* and 7*r* are/is moved into their adjusted positions/its adjusted position and the desired spread X is set as a result only when the web strands Bl and Br have passed over the outlet guide means 8 located closest to the outlet guide means 7*l* and 7*r* in the downstream direction of the web. Due to the displacement movement of the second deflecting means 6*l* and/or 6*r* and of the outlet guide means 7*l* and/or 7*r*, which takes place continuously within the framework of the setting, the web strands Bl and Br are spread apart from one another in parallel continuously until the spread X is set.

To reduce the friction, the deflecting means 5*l* through 6*r* have blast air holes on their jacket surfaces, through which holes blast air can be admitted to the wrapping-around web strands Bl and Br, as is known in connection with turning bars. As soon as one of the deflecting means 5*l* through 6*r* is moved against the corresponding web strand Bl or Br, the blast air is switched on. The blast air is switched on, of course, in an automated manner, for example, as a function of the adjusted position of the second deflecting means 6*l* and 6*r* and preferably under the control of the control means 15.

As was mentioned above, the web strand planes defined by the second deflecting means 6*l* and 6*r* and the outlet guide means 7*l* and 7*r* are parallel to the web plane defined by the intake guide means 3 and the first deflecting means 5*l* and 5*r*. The web plane between the intake guide means 3 and the first deflecting means 5*l* and 5*r*, on the one hand, and the web strand planes between the second deflecting means 6*l* and 6*r* and the outlet guide means 7*l* and 7*r*, on the other hand, are parallel to one another in all adjusted positions.

The adjustment paths of the second deflecting means 6*l* and 6*r* and outlet guide means 7*l* and 7*r*, which adjustment paths are preset by the two linear guides 11, extend perpendicularly linearly to the web plane defined by the intake guide means 3 and the first deflecting means 5*l* and 5*r*. The adjustment paths point over part of their linear length in the conveying direction F, which the web strands Bl and Br have between the deflecting means 5 and 6 in case of their being wrapped around. The partial lengths pointing in the conveying direction F extend from the particular position for maximum spreading to a position before the position for zero spreading, which is indicated by broken line in FIG. 1. It arises from this that the second deflecting means 6*l* and 6*r* first immerse into the particular web strand Bl and Br from zero spreading during adjustment in the direction of the end position of maximum spreading. During a first phase of the contact of the second deflecting means 6*l* and 6*r* with the web, the wrapping angle between the web strands Bl and Br and the deflecting means 5 and 6 changes continuously beginning from the respective first web contact to another adjusted position. The wrapping angle of the respective web strand Bl and Br remains unchanged beginning from the additional adjusted position, which will hereinafter be called the first position, to the position of maximum spreading. If the deflecting means 5 and 6 have equal diameters, which is preferred, the first position, beginning from which the wrapping angles no longer change in the course of the further movement in the direction of the position of the maximum spreading, is reached when the left-hand deflecting means 5*l* and 6*l* in relation to the left-hand web strand Bl and the right-hand deflecting means 5*r* and 6*r* in relation to the right-hand web strand Br are at the same level. Thus, the wrapping angles are not changed during an adjustment of one of the second deflecting means 6*r* and 6*l* from the first position into each second position that is located between the first position and the position for maximum spreading and they are invariant in this sense against adjusting movements of the deflecting means 6*r* and 6*l*. It is advantageous, furthermore, that not only are the wrapping angles invariant per web strand Bl or Br against the possible adjustments of the respective associated second deflecting means 6*l* or 6*r*, but that the wrapping angle with which the left-hand web strand Bl wraps around its two deflecting means 5*l* and 6*l* and the wrapping angle with which the right-hand web strand Br wraps around its two deflecting means 5*r* and 6*r* are equal. The invariance of the wrapping angle is already advantageous in itself alone per web strand Br and/or Bl for regulating the web tension. The equality of the wrapping angles of the two web strand Bl and Br leads to a further simplification of the web tension regulation.

All deflecting means 5*l* through 6*r* point at a contact angle of 75° obliquely toward the conveying direction F of the web strands Bl and Br running up onto the first deflecting means 5, i.e., the running-in web strands Bl and Br in the first exemplary embodiment. In case of the invariance of the wrapping angle from the adjusting movements of the second deflecting means 6*l* and 6*r*, this also leads to a great parallel offset of the two web strands Bl and Br already in the respective first position.

Figure 5:
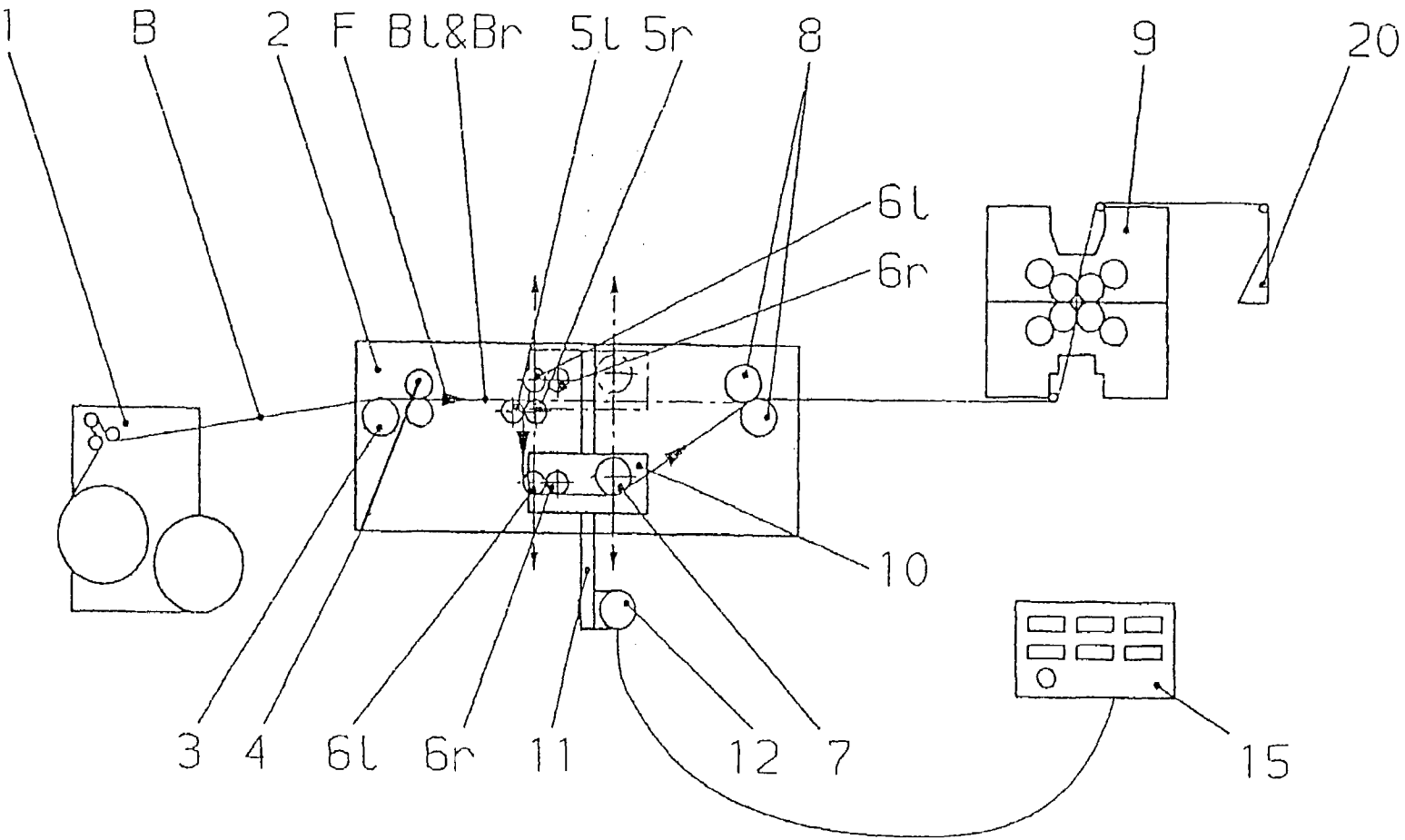
FIG. 5 is a schematic view of a web-spreading device according to a second exemplary embodiment in the same web-fed rotary printing press.
Figure 6:
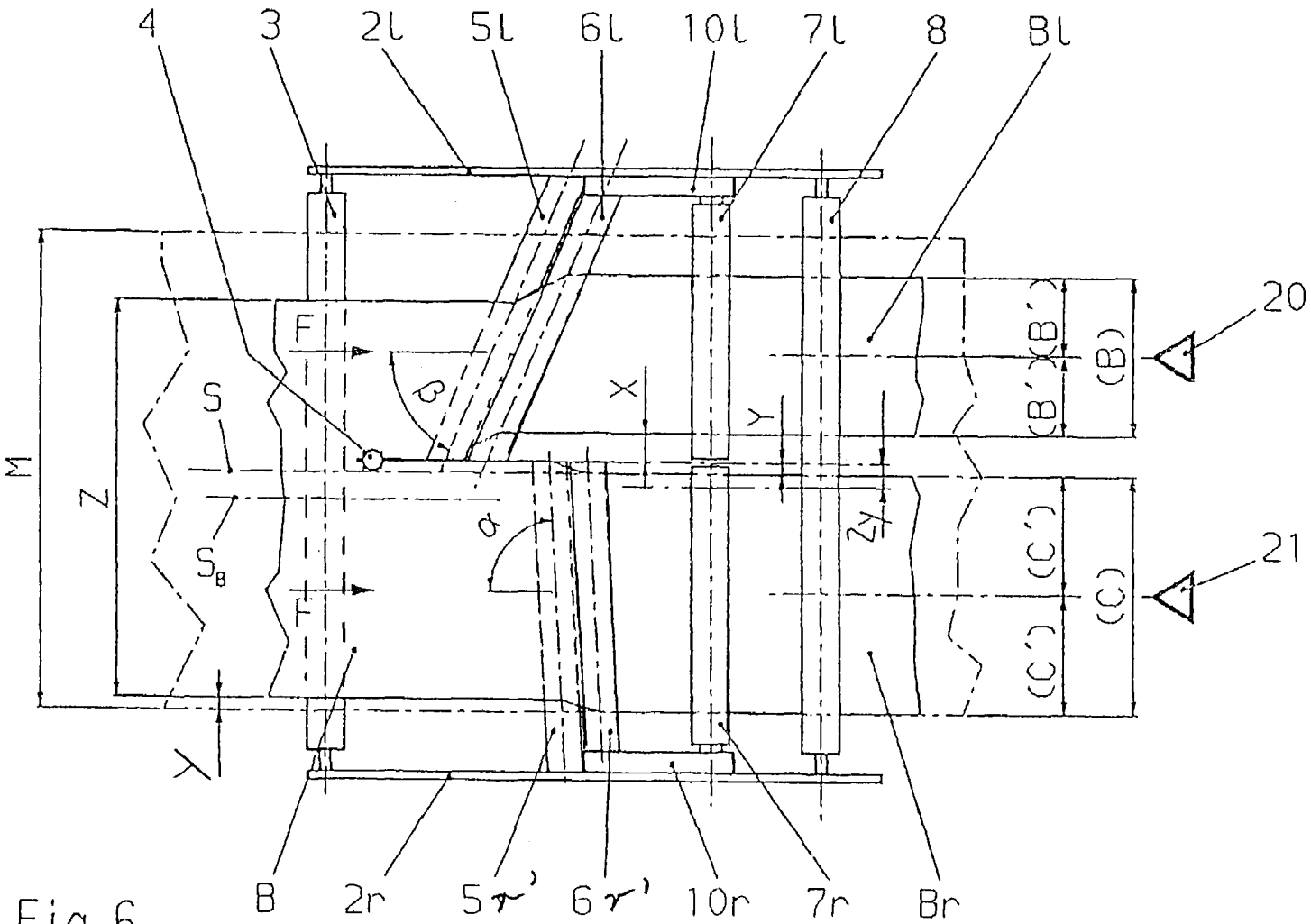
FIG. 6 is a view of the web-spreading device according to the second exemplary embodiment in a state in which the strands of a web are spread apart asymmetrically from one another and are led centrally to a former each.

FIGS. 5 and 6 show a web-spreading device according to a second exemplary embodiment. The web-spreading device according to the second exemplary embodiment differs from that according to the first exemplary embodiment only in terms of the positioning of the right-hand deflecting means to the conveying direction F of the running-in web strands Br and Bl and the offset of the lengthwise cutting means 4. The adjustment paths are likewise straight over their entire length and extend over a length section each in the conveying direction F, which the web strands Bl and Br have between the deflecting means 5 and 6 when the second deflecting means 6 assume a position each on the adjustment path section extending from the respective first position to the respective position for maximum spreading. As in the first exemplary embodiment as well, the adjustment paths extend in this conveying direction F only in the section between these two positions.

While the web-spreading device according to the first exemplary embodiment is configured in some productions, as they were described as examples on the basis of FIGS. 3 and 4, such that one of the webs Br and Bl is led through the spreading device without wrapping around the deflecting means 5 and 6 associated with it, the spreading device according to the second exemplary embodiment is modified from that according to the first exemplary embodiment such that the web strands Br and Bl conveyed through it are always offset in parallel preferably in each production and it always wraps around the respective deflecting means 5 and 6 associated with it with the same wrapping angle. The second deflecting means 5 and 6 are adjusted only for the purpose of drawing a new web into the intake position indicated by broken line, in which the beginning of the web can be drawn in through the spreading device without wrapping around the first and second deflecting means 5 and 6.

To preserve the invariance of the wrapping angle for the productions according to FIGS. 3 and 4 as well, the spreading device according to the first exemplary embodiment may be modified such that one of the web strands Bl and Br, for example, the second one, i.e., the left-hand web strand Bl, is not offset in parallel in any of the adjusted positions of the second deflecting means 6*l*, but it runs through the spreading device without offset in each of the adjusted positions. The first left-hand deflecting means 5*l* and the second left-hand deflecting means 6*l* would point in this case exactly at right angles to the conveying direction F of the left-hand web strand Bl running in, and the second left-hand deflecting means 6*l* would be arranged offset above or under the web plane of the running-in web strand Bl only to obtain the equality of the wrapping angles in relation to the web plane of the web strand Bl running in.

However, FIG. 6 shows, compared with this, a preferred modification of the spreading device according to the first exemplary embodiment. The left-hand deflecting means 5*l* and 6*l* correspond to the deflecting means 5*l* and 6*l* according to the first exemplary embodiment. However, the right-hand deflecting means are modified compared with the first exemplary embodiment and are therefore designated by 5*r*' and 6*r*'. The deflection axes formed by the deflecting means 5*r*' and 6*r*' are again parallel to one another, but symmetrical to the deflection axes of the left-hand deflecting means 5*l* and 6*l* in relation to the machine axis S. The right-hand deflecting means 5*r*' and 6*r*' and consequently also the deflection axes formed by them point at a contact angle $\alpha$ obliquely to the conveying direction F of the web strand Br running in. The acute angle formed by the particular deflection axis with the conveying direction F of the web strand Br and Bl running in, i.e., the web strand Br and Bl running onto the first deflecting means 5*r*' and 5*l* in the web plane of the web strand Br and Bl running in is defined as the contact angle $\alpha$ and as the contact angle $\beta$. The contact angle $\alpha$ is greater than the contact angle $\beta$ at which the left-hand deflecting means 5*l* and 6*l* and especially the deflection axes of these deflecting means point obliquely to the conveying direction F of the left-hand web strand Bl running in. The contact angle $\alpha$ should be greater than 85° and smaller than 90° and it equals 87° in the exemplary embodiment.

The adjustment path length of the second right-hand deflecting means 6*r*' is selected to be such that the right-hand web strand Br is offset in parallel by the offset 2Y in the end position for maximum spreading. The lengthwise cutting means 4 is offset by the amount Y, i.e., by half the maximum offset, in relation to the machine axis S. The second right-hand deflecting means 6*r*' assumes its first position in case of the offset Y. The right-hand web strand Br can be corrected laterally within the offset range from 0 to 2Y. However, only the range between Y and 2Y is utilized in all productions to obtain the invariance of the wrapping angle. The left-hand web strand Bl is offset, as in the web guiding examples according to FIGS. 3 and 4, by the amount X in parallel to its intake.

In the exemplary embodiment shown in FIG. 6, the web B has the width Z. The web B is conveyed into the spreading device asymmetrically in relation to the machine axis S. Its right-hand outer edge has the distance Y from the right-hand limiting line. The right-hand deflecting means 5*r*' and 6*r*' are used as web edge controls in order to offset the right-hand web strand Br with its right-hand web edge to the right-hand limiting line. The former 21 associated with the right-hand web strand Br is arranged at such a distance from the machine axis S that the right-hand web strand Br offset in parallel by the offset Y is conveyed centrally to the former 21. The two web strands Bl and Br are spread apart from one another by the total spread X+Y in the web guiding example according to FIG. 6.

In the two exemplary embodiments as shown in FIGS. 1 and 5, the adjustment paths of the second deflecting means 6*l* and 6*r*, on the one hand, and 6*l* and 6*r*', on the other hand, point perpendicularly to the conveying direction F of the running-in web strands Bl and Br. In alternative embodiments, the adjustment paths may also extend obliquely to the conveying direction F of the running-in web strands Bl and Br, i.e., at a slope angle, especially at the same slope angle. However, it also applies to obliquely extending adjustment paths that such adjustment paths are straight and extend at least in a partial section in the conveying direction F which the web strands Bl and Br have between the first deflecting means 5*l* and 5*r* and the second deflecting means 6*l* and 6*r* or 6*r*'. The web planes of the web strands Bl and Br are also preserved in case of such adjustment paths pointing obliquely to the running-in web strands Bl and Br between the deflecting means 5 and 6 during adjustments between the first position and the position of maximum spreading.

While specific embodiments of the invention have been shown and described in detail to illustrate the application of the principles of the invention, it will be understood that the invention may be embodied otherwise without departing from such principles.

What is claimed is:

1. A web-spreading process, comprising the steps:

a) conveying a first web strand and a said second web strand next to one another in a web-processing machine and offset in parallel to one another by a spread;

b) wrapping the first web around a first deflecting means, which forms a first deflection axis, and a second deflecting means, which is a next deflecting means downstream along the web and forms a second deflection axis, each of the first deflecting means and the second deflecting means having a wrapping angle and providing a first web parallel offset;

c) adjusting at least one of the first deflecting means and second deflecting means from a first position into a new, second position, in which the first web strand travels between the first deflecting means and the second deflecting means over a path length that is different from that in the first position, but maintaining a conveying direction so that the spread is adjusted, but said wrapping angle is not changed by the adjustment of said at least one of the first deflecting means and second deflecting means.

2. A web-spreading process in accordance with claim 1, wherein the wrapping angle is always the same in the first position and in the different new positions of said at least one of the first deflecting means and second deflecting means.

3. A web-spreading process in accordance with claim 1, wherein the wrapping angle is the same in each position into which said at least one of the first deflecting means and second deflecting means is adjusted for a production or in a production.

4. A web-spreading process in accordance with claim 1, wherein the second web strand wraps around an additional first deflecting means, which forms a first deflection axis for the second web strand, and wraps around an additional second deflecting means, which is the next deflecting means downstream along the web and forms a second deflection axis for the second web strand, with a respective wrapping angle and providing a second web parallel offset.

5. A web-spreading device in accordance with claim 4, wherein for the adjustment of the spread, at least one of the additional deflecting means is adjusted from a first position into a new, second position, in which the second web strand travels between the first and second additional deflecting means over a path length that is different from the path length in the first position of the at least one of the additional deflecting means but maintains a conveying direction so that the spread is adjusted but the wrapping angle of the second web strand is not changed by the adjustment of the at least one of the additional deflecting means.

6. A web-spreading process in accordance with claim 4, wherein the wrapping angle of the first web strand and the wrapping angle of the second web strand are equal at different amounts of parallel offset of the web strands.

7. A web-spreading process in accordance with claim 4, wherein the wrapping angle of the second web strand is always the same in the first position and in different new positions of the at least one of the additional deflecting means.

8. A web-spreading process in accordance with claim 4, wherein the wrapping angle of the second web strand is the same in each position in which the at least one of the additional deflecting means is adjusted for a production or in a production.

9. A web-spreading device by which a first web strand being conveyed and a second web strand being conveyed next to the first web strand in a processing machine can be offset in parallel to one another in order to set a spread therebetween, the web-spreading device comprising:

a frame;

a first deflecting means which forms a first deflection axis for the first web strand;

a second deflecting means which forms a second deflection axis for the first web strand, said deflection axis being the next deflection axis to the first deflection axis in a conveying direction of the first web strand, the first web strand being offset in parallel by wrapping around the first deflecting means and second deflecting means to set the spread in its entirety or partially;

an adjustment device with adjustment path, at least one of said first deflecting means and second deflecting means being mounted adjustably along an adjustment path in the frame in order to make it possible to adjust the spread, said adjustment path being straight in its entirety or at least straight in one section and extending in a conveying direction of the first web strand between the first and second deflecting means.

10. A web-spreading device in accordance with claim 9, wherein said at least one of said adjustable deflecting means is adjustable along the adjustment path from a first position in the conveying direction into an end position, and the wrapping angle of the first web strand is the same in the first position and in the end position.

11. A web-spreading device in accordance with claim 9, further comprising:

an additional first deflecting means, which forms a first deflection axis for the second web strand; and an additional second deflecting means, which is the next deflecting means for said additional first deflecting means in the conveying direction of the second web strand and forms a second deflection axis for the second web strand;

wherein the second web strand is offset in parallel by wrapping around said additional first and second deflecting means and the spread is thus set in its entirety or in part for the second web.

12. A web-spreading device in accordance with claim 11, further comprising a frame, wherein at least one of said additional deflecting means is mounted adjustably along an adjustment path in said frame in order to make it possible to set the spread, and that the adjustment path of said at least one of the additional first and second deflecting means is straight in its entirety or at least in a section and extends in the conveying direction, of the second web strand between said first and second additional deflecting means.

13. A web-spreading device in accordance with claim 9, wherein said deflecting means for at least one of the web strands point obliquely to the conveying direction of the at least one of the web strands at a contact angle relative to the running-in web strands that is greater than 80° and smaller than 90°.

14. A web-spreading device in accordance with claim 11, wherein said first and second deflecting means for the first web strand point obliquely to the conveying direction of the first web strand running in at a first contact angle, and said first and second deflecting means for the second web strand point in the conveying direction of the second web strand running in at a different angle, and that the first angle and the second angle are unequal.

15. A web-spreading device in accordance with claim 14, wherein the other angle is a contact angle of less than 90° so that said additional first and second deflecting means for the second web strand point obliquely to the conveying direction of the second web strand running in when viewed in the plane of the second web strand running in.

16. A web-spreading device in accordance with claim 11, wherein said at least one adjustably mounted deflecting means of the first web strand is movable in relation to said additional deflecting means of the second web strand by an adjustment path length, so that the strand paths of the web strands can be set in mutually different lengths between said deflecting means of the first web strand and between said additional deflecting means of the second web strand.

17. A web-spreading device in accordance with claim 11, wherein at least one of said deflecting means is supported at a frame at one end only and projects freely from said frame with its other end.

18. A web-spreading device in accordance with claim 11, further comprising an outlet guide means of the first web strand and a additional outlet guide means of the second web strand, each of said outlet guide means being mounted movably in relation to one another in the frame following the respective second deflecting means in the web conveying direction, said outlet guide means and said second deflecting means being movably mounted to be moved into adjusted positions in which they together define a plane each for the respective web strands.

19. A web-spreading device in accordance with claim 18, wherein the outlet guide means and the second deflecting means for the first web strand are mounted such that they can be moved together, and the additional outlet guide means and the additional second deflecting means are also mounted such that they can be moved together.

20. A web-spreading device in accordance with claim 9, further comprising a control means comprising a drive means for the at least one adjustably mounted deflecting means in order to adjust the at least one adjustably mounted deflecting means into the adjusted position necessary for setting the spread.

21. A web-spreading device in accordance with claim 9, wherein the at least one adjustably mounted deflecting means projects from a carriage, which is guided on a linear guide of a frame.

22. A web-spreading device in accordance with claim 9, further comprising a lengthwise cutting means for cutting the web into the first web strand and second web strand, said lengthwise cutting means and said first and second deflecting means being mounted such that they can be moved together at right angles to the conveying direction of the web in relation to the web.

23. A web-spreading device in accordance with claim 9, wherein said web-spreading device is used as a final control element of a web edge control of at least one of the web strands.

* * * * *